United States Patent [19]

Gale

[11] 4,343,161

[45] Aug. 10, 1982

[54] OUTBOARD MOTOR LOCK

[76] Inventor: Charles Gale, General Delivery, Block Island, R.I. 02807

[21] Appl. No.: 151,764

[22] Filed: May 21, 1980

[51] Int. Cl.[3] ..... E05B 73/00

[52] U.S. Cl. ..... 70/14; 70/167; 70/232; 138/89

[58] Field of Search ..... 70/39, 14, 57, 58, 167–169, 70/228, 232; 138/89, 96; 137/383

[56] References Cited

U.S. PATENT DOCUMENTS 3,631,896 3/1970 Meigs ..... 138/89

*Primary Examiner*—Robert L. Wolfe

*Attorney, Agent, or Firm*—Curtis, Morris & Safford

[57] ABSTRACT

A device for preventing the theft or unauthorized use of an outboard motor, of the type having a remote fuel tank and a detachable fuel line, locks to the fuel line coupling of the outboard motor, thereby preventing the unauthorized connection of the fuel line to the fuel line coupling so that the motor cannot be used. The device includes a body having recesses or sockets therein for receiving and covering members, including a fuel nipple, which extend from the fuel line coupling; an engaging member that selectively engages with a projection on one of such members, or another facet of the motor or housing; and an arrangement for lockably holding the engaging member in engagement with the projection or facet. One version of the device fits an Evinrude or Johnson outboard motor; another version fits a Mercury outboard motor.

3 Claims, 7 Drawing Figures

OUTBOARD MOTOR LOCK

BACKGROUND OF THE INVENTION

Field of the Invention

This invention relates to a lock for an outboard motor, and particularly relates to a lock which prevents coupling of a detachable fuel line to the outboard motor.

Outboard motors are commonly used for powering boats, both in marine and in fresh-water use. Because outboard motors are not built-in, but rather are only removably affixed to the boat, and because outboard motors are high-value items, there has been an alarmingly high frequency of outboard motor thefts. Yet, because of the inconvenience in removing the outboard motor from the transom of an owner's craft, it is difficult for the owner of the outboard motor to remove it to a secure location after each use. Thus, attempts have been made to secure the outboard motor to the craft in a fashion which will prevent theft.

One such attempt, described in U.S. Pat. No. 3,943,738, involves an outboard motor lock that has a bar that slides over, and locks onto the heads of transom hold-down bolts associated with the outboard motor. When this outboard motor lock is in place on a outboard motor, the latter cannot be removed from the boat. In order to prevent theft or unauthorized use, the owner secures his motor to his boat with such a lock, and then removes the gas tank and/or fuel line from the outboard motor.

While the outboard motor lock of that patent effectively prevents removal of the outboard motor from the boat, it cannot altogether prevent theft of the boat and motor, and cannot prevent the unauthorized use of the boat and motor, or "joyriding."

In fact, if a thief or unauthorized user desires to steal or make use of a boat secured in this manner, it is a simple matter for him to supply his own tank and fuel line. Even if the electrical system is locked and the battery is removed from the boat, the outboard motor can usually be started by hand-cranking it. Such security measures as clamp locks, fuel tank or hose removal, ignition switch locks, etc. are easily circumvented and the motor (and boat) are not secured against unauthorized use unless the engine is rendered inoperable, such as by positively restricting the supply of fuel. It is apparent that such previous attempts to secure the outboard motor are quite easily averted.

OBJECTS AND SUMMARY OF THE INVENTION

It is an object of this invention to provide an outboard motor lock which overcomes the defects inherent in prior-art outboard motor locks.

It is a further object of this invention to provide an outboard motor lock which will prevent unauthorized operation of the outboard motor, notwithstanding that a thief or unauthorized user might provide his own tank and fuel line, and that the outboard motor can be started by hand.

It is another object of this invention to provide an outboard motor lock that denies unauthorized access to the fuel line coupling of an outboard motor, so that an unauthorized person cannot connect a fuel line to the outboard motor.

In accordance with an aspect of this invention, an outboard motor lock includes a body having sockets for receiving and covering protruding members on the fuel line coupling of the outboard motor to prevent the unauthorized connection of a fuel line to the fuel line coupling so that the motor cannot be used. The outboard motor lock further includes an engaging member that selectively engages with a projection on one of such protruding members, and an arrangement for lockably holding the engaging member in engagement with the projection. In one version, the outboard motor lock can be used with an outboard motor of the type manufactured by the Evinrude Motors Division or the Johnson Outboards Division of Outboard Marine Corporation. In another version, the lock can be used with outboard motors of the type manufactured by the Mercury Division of the Brunswick Corporation.

DETAILED DESCRIPTION OF PREFERRED EMBODIMENTS

Figure 1:
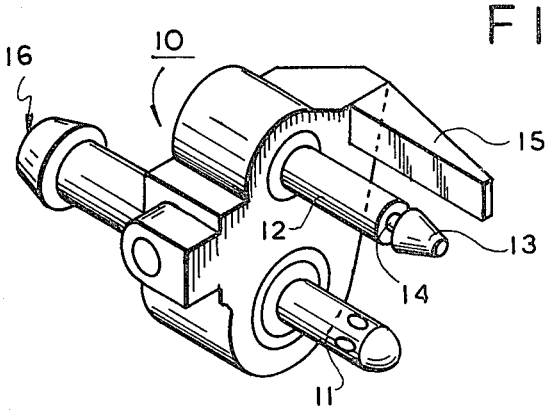
FIG. 1 shows one type of fuel line coupling with which the outboard motor lock of this invention is used.

FIG. 1 shows a fuel line coupling of the type used on the outboard motors manufactured by the Evinrude Motors Division and by the Johnson Outboards Division of Outboard Marine Corporation. Such fuel line coupling 10 is mounted either on the front or on the side of the outboard motor housing (not shown) so that a fuel line can be quickly and easily connected and/or disconnected by means of a fuel line coupling connector on the fuel line. In the fuel line coupling 10, a fuel nipple 11 receives the fuel supplied through the removable fuel line. A coupling stud 12, generally cylindrical in shape, has a conical nose portion 13 and a stem portion 14, of smaller diameter than either the cylindrical portion or the base of the conical nose 13, so that the base of the nose 13 forms a flange portion which projects radially from the stem 14. A locking lever on the fuel line coupling connector attaches to the coupling post by clamping to the stem 14 beneath the flange portion of the base of the nose 13. Also on the fuel line coupling 10, an alignment pin 15 is provided to assure that the fuel line coupling connector is properly aligned when connected, and a second nipple 16 is provided to furnish fuel to internal fuel lines, and thence to the fuel pump and carburetor or fuel injector of the motor.

Figure 2:
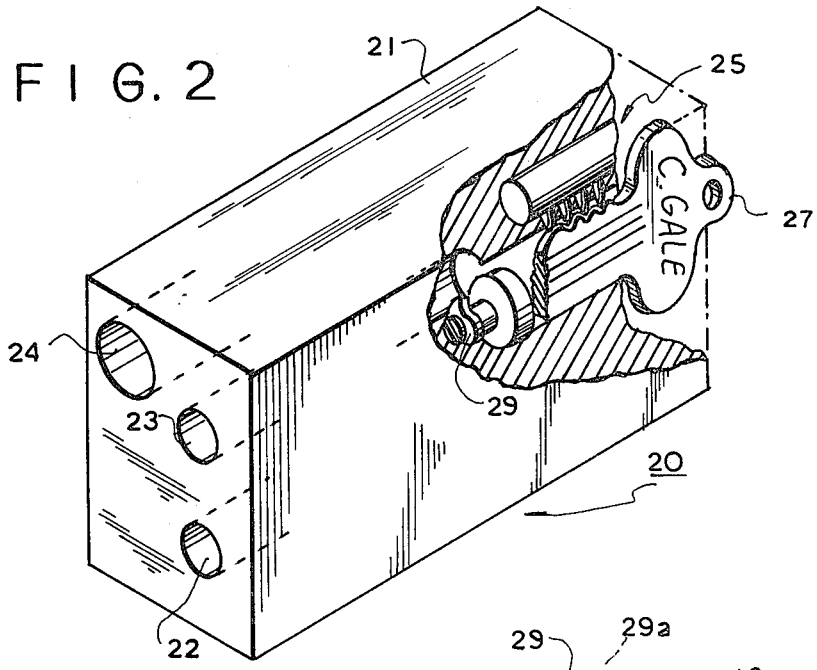
FIG. 2 is a perspective view, partially cut away, showing a first embodiment of the outboard motor lock of this invention.
Figure 3:
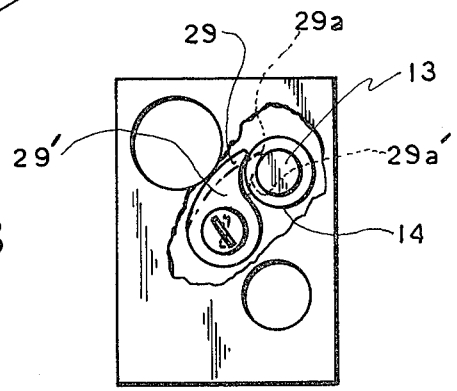
FIG. 3 shows a portion of the outboard motor lock of FIG. 2.

A first embodiment of the outboard motor lock of this invention is shown in FIG. 2. This lock 20 is particularly adapted for use with the Outboard Marine Corporation type of fuel fitting or fuel line coupling 10, and effectively denies unauthorized access thereto, as described below. Such a coupling 10 is almost universally used and is found on the outboard motors of many manufacturers. The outboard motor lock 20 is formed of a body 21 having sockets 22, 23, 24, in one face therein for receiving and overfitting the projecting fuel nipple 11, coupling stud 12, and alignment pin 15, respectively. Within the body 21 is a lock cylinder plug 25 which is rotatable when its pin tumblers 26 are aligned by a key 27. In this embodiment of the outboard motor lock 20 a plate 29 is arranged to rotate on a cam 25*a* with the cylinder 25, as better shown in FIG. 3. The plate 29 rotates from an open, or unlocked position, as shown in solid lines, in which the plate 29, and particularly an engaging portion thereof 29*a*, are completely outside the socket 23 so that the coupling stud 21 can be inserted into or removed from the lock 20, to a closed or locked position, as indicated by reference numeral 29' and shown in phantom lines. In this locked position, the engaging portion 29'*a* partially obstructs socket 23 and lodges beneath a portion of the flange portion at the base of the nose 13. There is normally a 45° angle between the open and closed position, but this angle depends on the construction of the lock cylinder.

In operation, the owner of the outboard motor can secure the fuel line coupling thereof, by first removing the fuel line coupling connector, and then in its place attaching the outboard motor lock 20. When the lock 20 is in place, the key 26 is turned so that the plate 29 is in its locked position engaging beneath the projecting nose 13, and the key 27 is removed.

Figure 4:
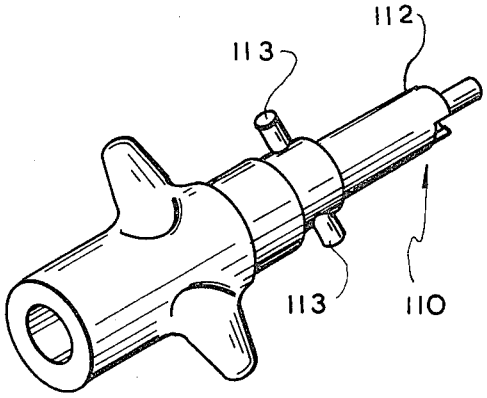
FIG. 4 shows another type of fuel line coupling with which the lock of the invention is used.

FIG. 4 shows a Mercury-type fuel line coupling or fitting 110. This coupling 110 has a bayonet-type fuel nipple, formed as a hollow post 112 with two radially projecting retaining teeth 113 to engage a fuel line coupling connector, formed as a female bayonet fitting.

Figure 5:
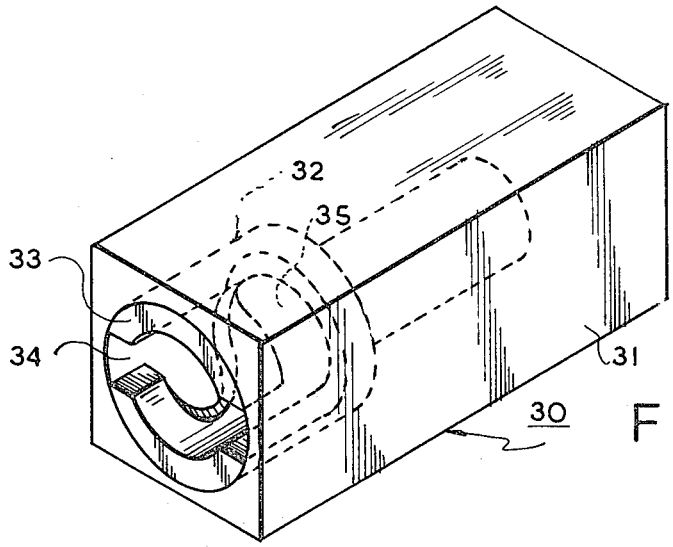
FIG. 5 is a perspective view of a second embodiment of the outboard motor lock of this invention.
Figure 6:
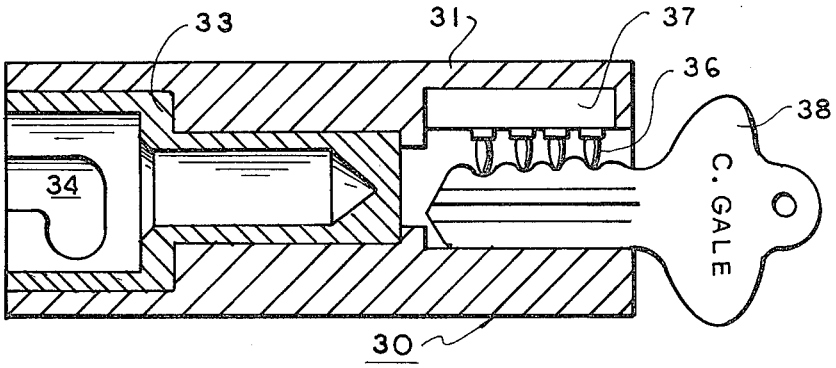
FIG. 6 is a sectional view of the embodiment of FIG. 4 taken along the line 5—5.

A second embodiment of this invention, which can be used to secure the Mercury-type fuel line coupling 110 is shown in FIGS. 5 and 6. This outboard motor lock 30 comprises a body 31 which has a cylindrical bore 32 in one face thereof. A hollow cylindrical sleeve 33 having a pair of oppositely-arranged L-shaped cutouts 34,35 therein is snugly, but rotatably positioned in the socket 32. This sleeve acts as a female bayonet fitting. The inside of the hollow sleeve 33 is dimensioned to fit over the fuel line coupling 110. The sleeve 33 is connected to rotate with a lock cylinder 36, here shown having a set of pin tumblers 37 which are aligned by means of a key 38. When the key 38 is in place, the sleeve 33 is rotatable between an open position, in which the teeth 113 are free to slide in the cutouts 34,35 and a closed position in which the teeth 113 are blocked from sliding in the cutouts. Further, the body 31 is so shaped and dimensioned to fit in a recessed sleeve or socket surrounding the fuel line coupling 110 on the outboard motor housing, so that the body 31, once in place, is not itself rotatable on the outboard motor. Once the lock 30 is in place on the fuel line coupling, the cylinder 36 and sleeve 33 are rotated to the engaging position of the latter, and the key 38 is removed. No unauthorized person can connect a fuel line to the coupling 110.

Figure 7:
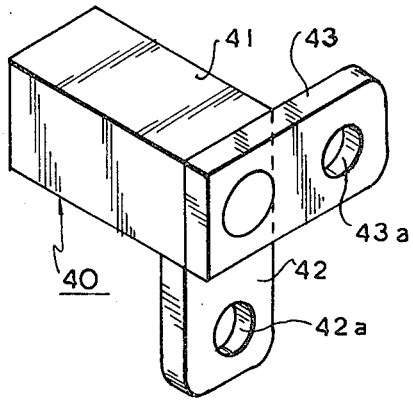
FIG. 7 is a perspective view of still another embodiment of the lock of this invention.

While certain embodiments have been specifically shown and described, it is quite possible to construct other devices embodying the spirit of this invention. For instance, FIG. 7 shows a device 40 which can be used with an external lock, such as a padlock. The device 40 includes a body 41 which can be arranged to accommodate, for example, the fuel line coupling connector 10, or that 110 of the Mercury outboard motor, or can instead be adapted to lock to the fuel line coupling of any other type of outboard motor. However, unlike the outboard motor locks 20 and 30, the device 40 does not have an integral lock cylinder. Instead, at one end of the block 41, an extension 42 is provided having an aperture 42*a* therein. Also, a locking lever 43 is provided which also has an aperture 43*a*. When the device 40 is placed over the fuel line coupling of an outboard motor, the lever 43 is rotated to clamp the device 40 to the fuel line coupling and to align the apertures 42*a*, 43*a*. Then, a padlock can be passed through the apertures 42*a*, 43*a* to lock the device.

It would also be apparent that other types of locking arrangements could be used in connection with this invention. For instance, a combination type lock could be included, rather than the key-operated cylinders shown on devices 20 and 30.

Further modifications and variations would be apparent to a person of ordinary skill in the art, without departing from the scope and spirit of the present invention, which is defined in the appended claims.

I claim:

1. A security device for preventing unauthorized use of an outboard motor of the type to which a remote fuel source is connected by coupling of a detachable fuel line to a fuel line coupling on said outboard motor, wherein said fuel line coupling is formed as a hollow post having a pair of oppositely projecting radial retaining teeth thereon, said fuel line including a fuel line coupling connector detachably engageable with said radial retaining teeth on said post; the security device comprising:

covering means for covering said fuel line coupling so as to prevent connection of said fuel line coupling connector thereto, said covering means including a body having a cylindrical aperture therein arranged for overfitting said hollow post and said pair of teeth;

means for selectively engaging said retaining teeth on said hollow post when said covering means is in position on said fuel line coupling, said selectively engaging means including a hollow cylindrical sleeve fit in said socket and having an inside diameter sufficient to accommodate said post but smaller than the span of said teeth and having a pair of oppositely arranged axial cutouts to accommodate said teeth, said sleeve being rotatable between an open position wherein said teeth are free to slide in said cutouts and a blocking position wherein said teeth are block from sliding in said cutouts; and means for lockably holding said selectively engaging means in engagement with said retaining teeth on said post, so that removal of said covering means is prevented and unauthorized connection of said fuel line to said outboard motor is thereby denied.

2. A security device according to claim 1, wherein said lockably holding means is rotatable with respect to said covering means; said cylindrical sleeve is arranged to rotate with said lockably holding means between its open and blocking positions; and said lockably holding means is lockable at least in the position corresponding to the blocking position of said cylindrical sleeve.

3. A security device according to claim 2, wherein said lockably holding means includes a lock cylinder which is rotatable when a key is inserted therein.

* * * * *